US005833490A

United States Patent [19]

Bouldin

[11] Patent Number: 5,833,490

[45] Date of Patent: Nov. 10, 1998

[54] HIGH PRESSURE INSTRUMENT WIRE CONNECTOR

[75] Inventor: Brett W. Bouldin, Pearland, Tex.

[73] Assignee: PES, Inc., The Woodlands, Tex.

[21] Appl. No.: 540,160

[22] Filed: Oct. 6, 1995

[51] Int. Cl.[6] ..... H01R 13/59

[52] U.S. Cl. ..... 439/462; 439/589

[58] Field of Search ..... 439/461, 462, 439/271, 275, 277, 584, 587, 589, 891; 166/65.1, 66

[56] References Cited

U.S. PATENT DOCUMENTS

| | | | |
|---|---|---|---|
| 1,840,312 | 1/1932 | Dunmire | 439/462 |
| 2,619,515 | 11/1952 | Doane | 439/274 |
| 3,877,775 | 4/1975 | Barlow et al. | 439/587 |
| 3,904,812 | 9/1975 | Daffron | 439/271 |
| 4,053,196 | 10/1977 | Dunaway | 439/589 |
| 4,553,776 | 11/1985 | Dodd | 285/212 |
| 4,973,265 | 11/1990 | Heeren | 439/584 |
| 5,366,018 | 11/1994 | Van Steenwyk et al. | 166/65.1 |

*Primary Examiner*—Neil Abrams

[57] ABSTRACT

A high pressure connector for connecting an insulated electrical conductor or wire (24) to a recessed electrical contact (16) in a plug housing (10). The connector has a diameter smaller than the diameter of the plug housing (10) and is positioned within the plug housing (10) to electrically connect the wire (24) and the recessed electrical contact (16) without permitting high pressure well fluids from entering plug housing (10). A locking retainer (34) tightens a ferrule or seal (32) to provide a metal-to-metal seal that prevents pressurized well fluid from intruding into the plug housing (10). An electrical contact such as connector (44) engages conductor (30) of wire (24) and electrical contact (16) while permitting relative axial movement therebetween to facilitate tightening of locking retainer (34) to plug housing (10). Other retainers (76) and seals (72,80) can provide a metal-to-metal connection to prevent the well fluid from contacting the interior of plug housing (10). A test apparatus (84) can be adapted to test seals before the connector is installed downhole in the well."

18 Claims, 4 Drawing Sheets

HIGH PRESSURE INSTRUMENT WIRE CONNECTOR

BACKGROUND OF THE INVENTION

The present invention relates to a high pressure electrical connector for use downhole in a well. More particularly, the present invention relates to a high pressure electrical connector for connecting an insulated instrument wire to a plug or downhole well tool.

Instrument wire is installed in oil and gas wells to communicate electrical signals and power between downhole well tools and the surface. Because of the high pressures and temperatures typically found in wells, instrument wire is sheathed to prevent deterioration of the wire. Instrument wire typically is constructed with a multistrand electrical conductor clad with two layers of thermoplastic material and with an outer stainless steel sheath. The steel sheath is formed with a flat metal band rolled and seam welded around the outer elastomeric material. The steel is then drawn to the final dimension of the instrument wire.

The high pressures and temperatures downhole in wells requires electrical connectors that can accommodate wear, temperature expansion, and temperature cycling without permitting intrusion of pressurized fluids. Various connectors have been made to form downhole connections. U.S. Pat. No. 4,553,776 to Dodd (1985) illustrates a hydraulic tubing connector having one tubing length contacted with another tubing length end held in a housing. A first locking nut compresses a packing gland and metal packing rings, and a second packing nut compresses metal ferrules to connect the first tubing end to the first locking nut.

Another known electrical connector is illustrated in FIG. 1, wherein the electrical conductor is attached to an oversized plug. The plug is attached to a compression nut, and a ferrule provides metal to metal contact between the plug and the compression nut. The compression nut is substantially larger than the insulated conductor, and the bushing, ferrule and multiple seals provide multiple leak paths which can fail under pressure. Additionally, the overall plug dimension is long when compared to the diameter of the conductor. This dimension effectively prevents the connection from being positioned transversely in a well casing, and limits the design flexibility in positioning a tool connection.

Both types of electrical connections require a plug connector having an outside diameter greater than the diameter of the conductor. This oversize dimension is undesirable in wells because the connector creates an additional obstruction in the well. Additionally, these electrical connections do not uniformly provide metal to metal seals, and further require multiple connection points which each create potential failure points. Additionally, such connectors are long and prevent transverse connections from being constructed within the narrow dimensions of a well.

Accordingly, a need exists for a high pressure electrical connector for instrument wires that provides redundant metal to metal seals, that reduces the number of splices necessary for the connection, and that does not create an obstruction in the well. Such a connector should be sufficiently short to permit transverse well connections, and should permit pressure testing of the connector before the connector is installed in the well.

SUMMARY OF THE INVENTION

The present invention provides a high pressure connector, for connecting an insulated electrical conductor to an electrical contact in a housing recess, for use downhole in a pressurized well. The invention comprises a connector for insertion within the housing recess, wherein the connector has a first end in contact with the electrical connector and has a second end in contact with the electrical contact. A primary seal contacts the housing and the electrical conductor to prevent fluid migration therebetween, and a primary retainer is engagable with the housing for anchoring the electrical conductor. A secondary seal isolates the primary seal from the well pressure.

In other embodiments of the invention, the primary seal, housing, and outer surface of the electrical conductor can be metallic to create a metal-to-metal seal between the housing and electrical conductor. Additionally, the secondary seal and primary retainer can be metallic to provide a metal-to-metal seal between the primary retainer and the electrical conductor.

In other embodiments of the invention, the invention can incorporate a housing having a recess for retaining the electrical contact and the connector. Additionally, the connector can include a first end in contact with the electrical conductor, and a second end in contact with the electrical contact and in sliding engagement with the connector first end.

DESCRIPTION OF THE PREFERRED EMBODIMENTS

The present invention provides a significant advance over the prior art by providing a high pressure electrical connector for use downhole in wells which incorporates metal-to-metal seals, minimizes leak paths, and provides a slimbody configuration providing flexibility in the orientation of downhole connections.

Figure 1:
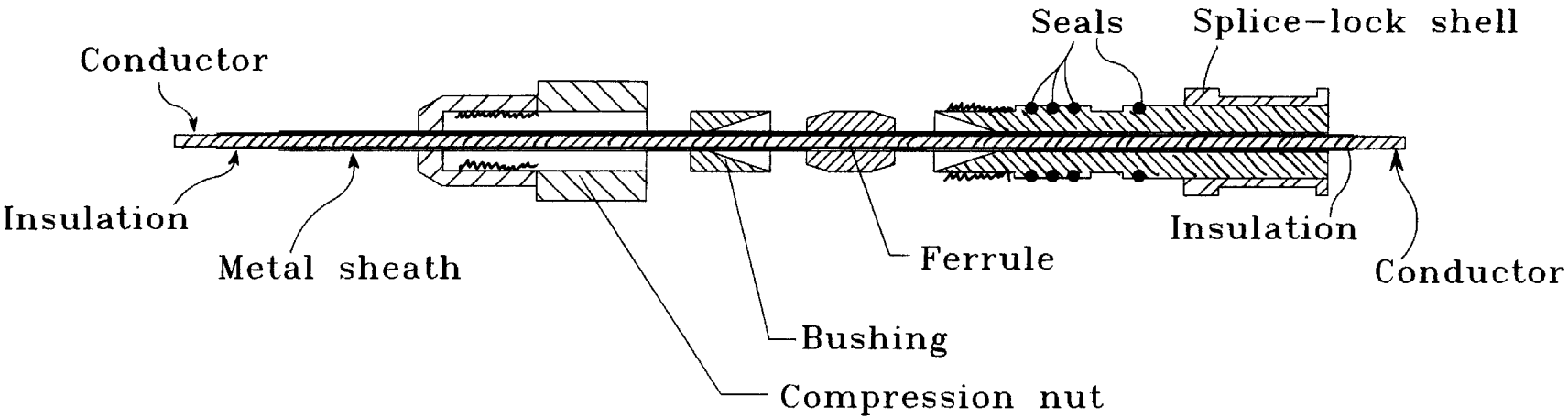
Fig. 1 Prior Art
FIG. 1 illustrates one embodiment of a known electrical connector.
Figure 2:
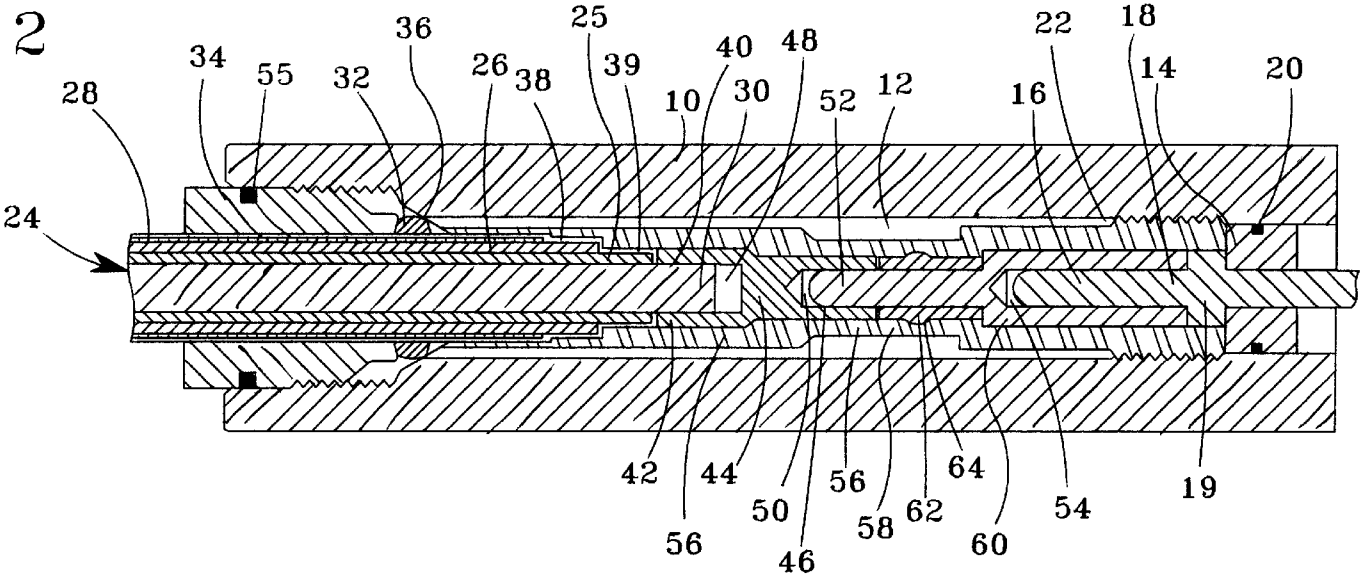
FIG. 2 illustrates a view of the invention showing a connector between an electrical conductor and an electrical contact.

As previously described, FIG. 1 illustrates one example of a high pressure electrical connector known in the prior art. FIG. 2 illustrates one embodiment of the invention wherein housing 10 includes recess 12 which forms a hollow space within housing 10. Bulkhead 14 retains electrical contact 16 which is connected to electrical conductor 18 with wire clamp 19. Conductor 18 can comprise an instrument wire or wires within a downhole well tool. Seal 20 prevents fluids from migrating past bulkhead 14, and retainer ring 22 is threadably engaged with housing 10 to retain bulkhead 14 in a fixed position.

Electrical conductor 24 is illustrated as a metal jacketed cable comprising insulation layer 25, insulation layer 26, metal sheath or jacket 28, and conductor 30. Metal ferrule or seal 32 is positioned between jacket 28 and housing 10, and is contacted by primary retainer 34 which is threadably engaged with housing 10. Rotation of retainer 34 relative to housing 10 urges seal 32 against housing bevel 36, which forces seal 32 into contact with housing 10 and metal jacket 28 to form a fluid tight metal-to-metal seal. Additionally, such connection also provides a strong mechanical connection between housing 10 and electrical conductor 24 and prevents relative movement in axial and rotational directions.

Sheath 28 is shorter than insulation 26 to leave insulation shoulder 38, insulation 26 is shorter than insulation 25 to create insulation shoulder 39, and insulation 25 is shorter than conductor 30 to leave exposed conductor shoulder 40. Shoulder 40 is attached to connector end section 42 of connector 44 and can be soldered, welded, crimped, or otherwise rigidly fastened to connector end section 42. End section 46 of connector 44 is engaged in electrical contact with electrical contact 16. In one embodiment of the invention as illustrated in FIG. 2, connector end section 42 includes recess 48 for engagement with the exposed end of conductor 24 and shoulder 40. Connector end section 42 also has another recess 50 opposite recess 48 which is in sliding engagement with pin end 52 of connector second end 46. Connector second end 46 includes recess 54 for engagement with electrical contact 16 and seal 55 is position between primary retainer 34 and housing 10.

The sliding engagement between connector first end section 42 and connector second end section 46 permits such ends to maintain contact with electrical contact 16 and electrical conductor 24 while permitting relative movement between connector first end section 42 and connector second end section 46. When primary retainer 34 is tightened relative to housing 10 to engage primary seal 32 and sheath 28, the overall distance between electrical contact 16 and electrical conductor 24 will be shorter, and such relative movement is accommodated by connector first end 42 and connector second end section 46. Such design maintains an unbroken electrical path from electrical conductor 24 through connector 44 to electrical contact 16.

In one embodiment of the invention, insulator 56 can be positioned between connector 44 and the interior wall of recess 12 in housing 10 to prevent movement or electrical conduction therebetween. One end of insulator 56 can be stepped to match the profile formed by shoulders 38, 39, and the end of sheath 28. Insulator 56 can comprise a single piece or two sections illustrated as insulator section 58 and insulator section 60. Section 60 has dog 62 which engages detent 64 in section 58 to provide a snap fitted connection therebetween.

Insulator 56 can also provide a pressure barrier or seal which prevents fluids form introducing into housing 10 and into contact with connector 44. For example, insulator 56 can be formed with a rubber or elastomeric material which provides a seal capable of withstanding up to 15,000 psi. The configuration of insulator 56 as it engages shoulders 38, 39 and 40 provides seals against each of the individual components.

Figure 3:
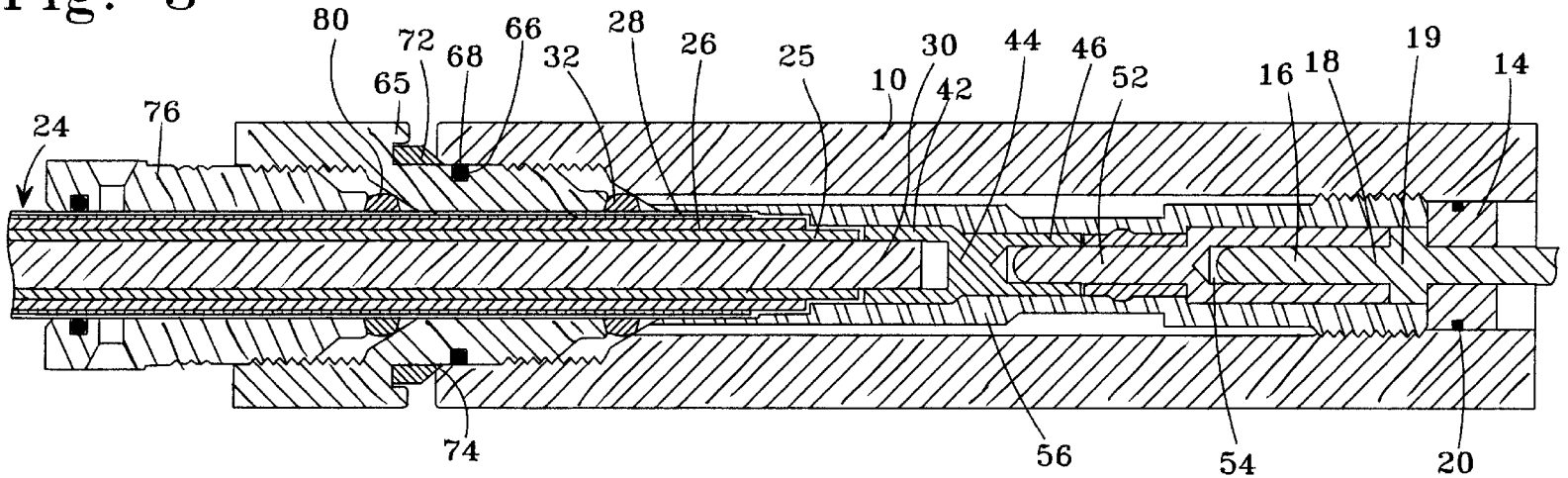
FIG. 3 represent another embodiment of the invention showing secondary seals which isolate a primary seal from the well pressure.

Referring to FIG. 3, primary retainer 65 can also contain recess 66 for retaining seal 68. Seal 68 can comprise an elastomeric seal between primary retainer 65 and housing 10. Secondary retainer 70 is in threaded engagement with primary retainer 34 and contacts secondary seal 72. In one embodiment of the invention, secondary seal 72 can comprise a metal ferrule which is urged against housing bevel 74. As secondary retainer 70 contacts secondary seal 72, a metal-to-metal seal connection is made between housing 10, secondary seal 72, and primary retainer 65.

FIG. 3 also illustrates end cap 76 in threaded engagement with primary retainer 65 which can include O-ring seal 78 between end cap 76 and primary retainer 65, and also contacts metal ferrule or seal 80 to form a metal-to-metal seal connection between primary retainer 65 and sheath 28. In this configuration, seal 80 provides a secondary or backup sealing function to primary seal 32 and prevents well fluids from contacting primary seal 32 through the gap between primary retainer 65 and sheath 28. This engagement between end cap 76 and seal 80 also provides a second mechanical connection between primary retainer 65 and sheath 28.

Figure 4:
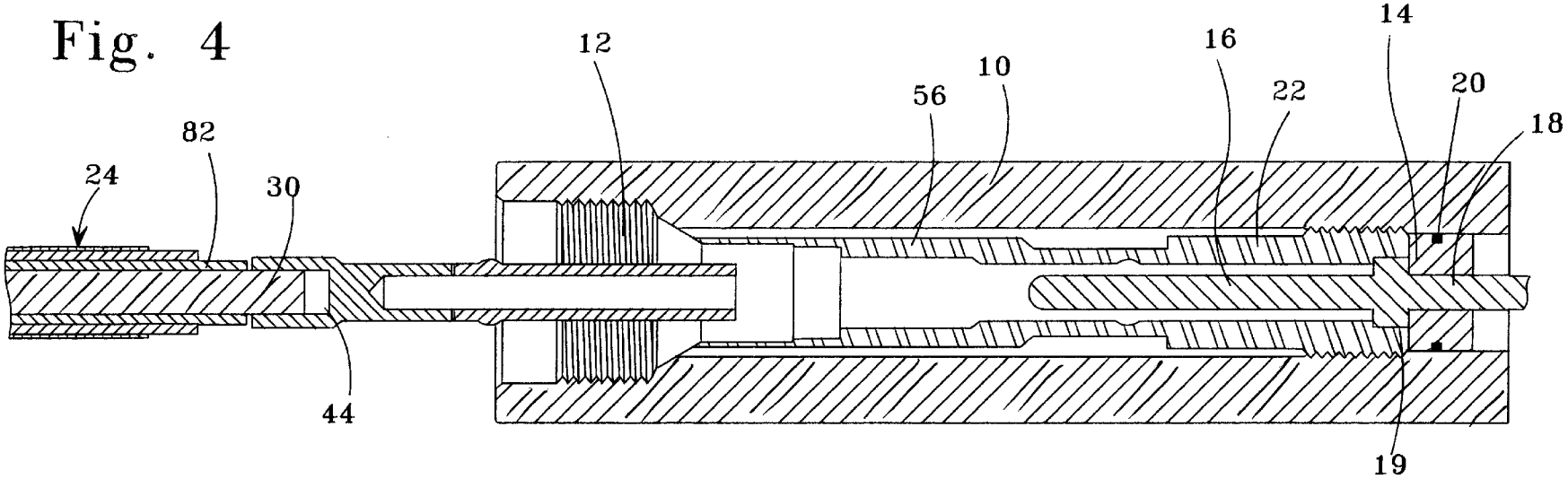
FIG. 4 illustrates a connector attached to the electrical conductor before the connector engages the electrical contact.
Figure 5:
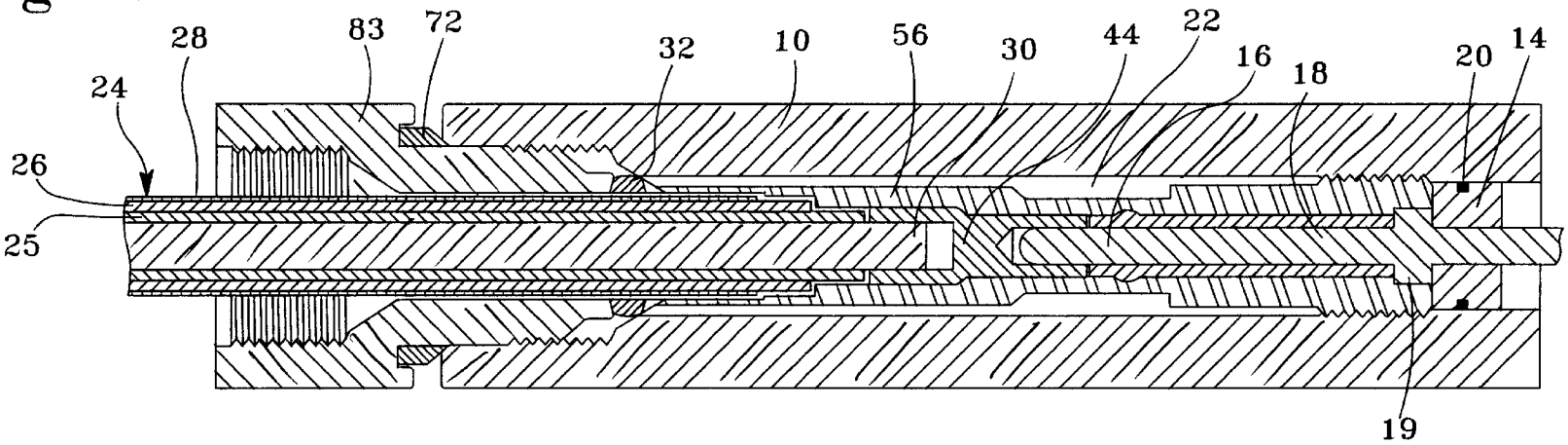
FIG. 5 represent another embodiment of the invention showing a primary configuration of a primary retainer.

FIG. 4 illustrates the invention as electrical conductor 24 is being inserted within recess 12 of housing 10. As shown, insulator 82 covers the exterior surface of connector 44 and prevents damage to connector 44 as electrical conductor 24 is inserted into recess 12. As shown in FIG. 5, primary retainer 83 is then threadably engaged with housing 10 to create the seal and mechanical connection between housing 10 and sheath 28 of electrical conductor 24.

Figure 6:
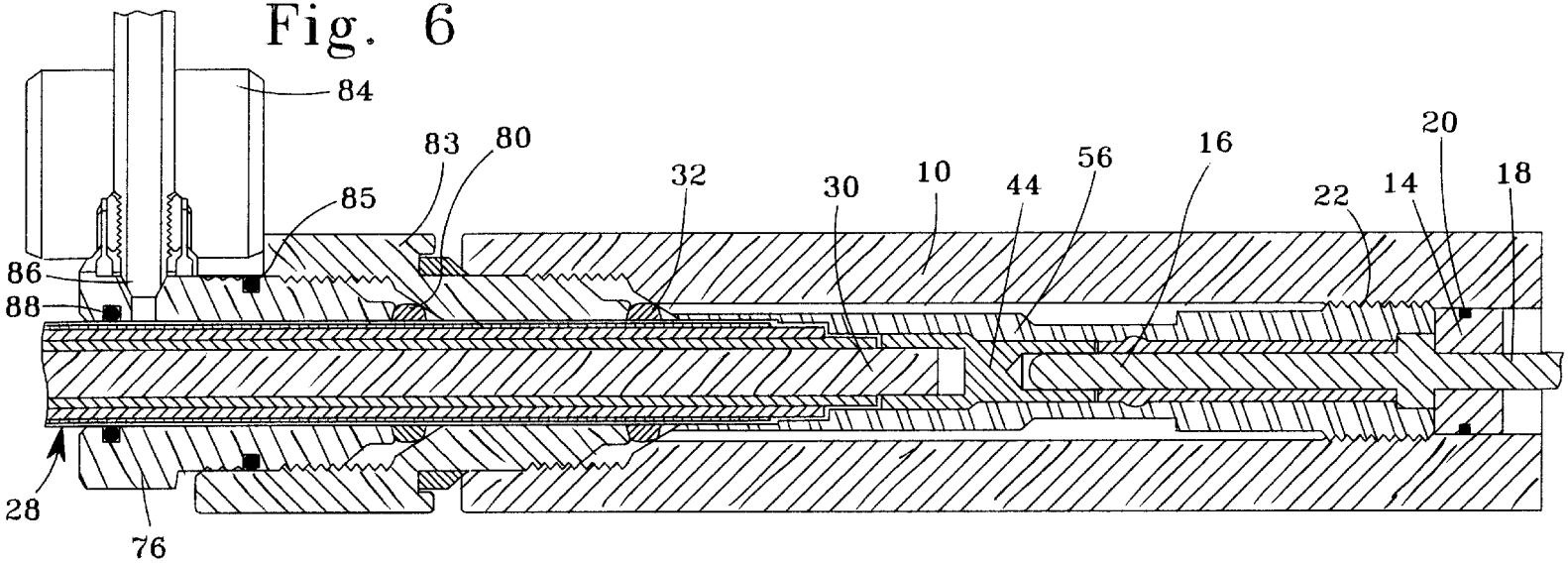
FIG. 6 illustrates the primary secondary seals showing a test apparatus for testing the integrity of the primary seal.
Figure 7:
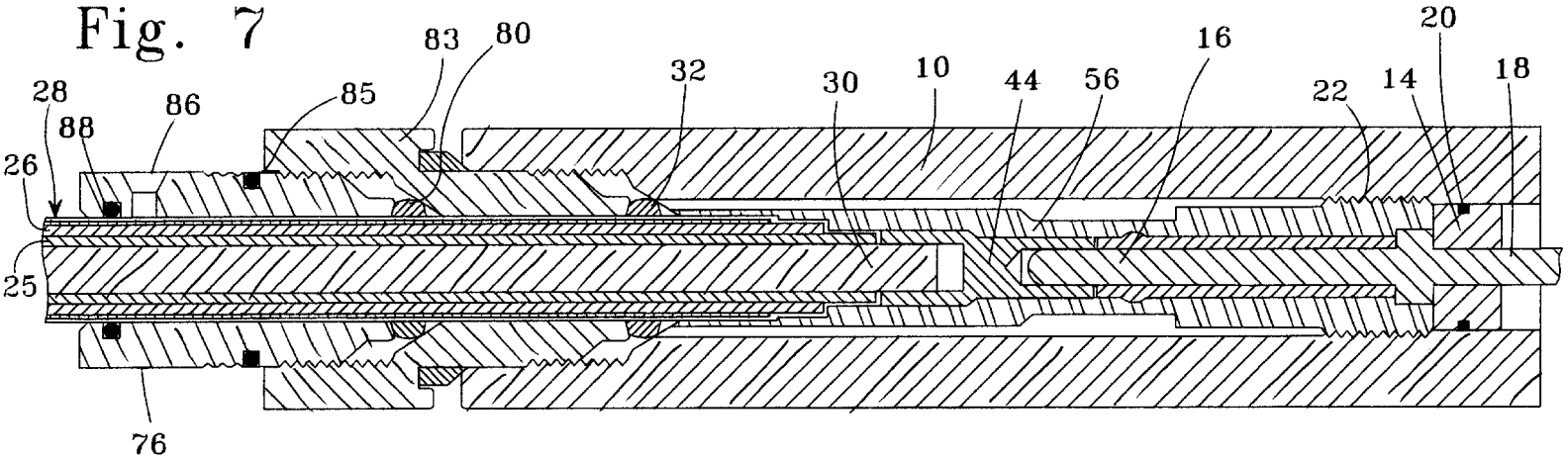
FIG. 7 illustrates an embodiment of the invention after the test apparatus is removed.

FIG. 6 shows end cap 76 having test apparatus 84 attached thereto to permit the selective pressure testing of seal 32 and O-ring 85 after the connections have been made up, but before end cap 76 is tightened to activate seal 80. Pressure is provided through aperture 86 in end cap 76. After the pressure testing is completed, test apparatus 84 can be removed, end cap 76 is tightened to activate seal 80, and cap ring 88 and seal 90 can be installed to seal aperture 86 as shown in FIG. 7. Test apparatus 84 can be used to test the operation of primary or secondary seals before the connector is positioned downhole.

Although the present invention can be used in numerous applications at the surface, in underwater applications, and in space, the present invention is particularly useful in the confined, high pressure environment downhole in a well. The invention provides a high pressure connector which is smaller in diameter than the sheathing for the instrument wire, and can provide metal-to-metal seals at all relevant interfaces. Although the invention works with metal-to-metal seals, the invention is equally applicable to components formed with plastics, composite materials, and other compounds. Additionally, the invention provides redundant seal capability without significantly increasing the size or cost of the connector. The invention has been described for use with a clad instrument wire, but is equally useful for making the connection between a wire and a downhole tool.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A high pressure connector for connecting an insulated electrical conductor to an electrical contact in a housing recess for use downhole in a pressurized well, comprising:

a connector for insertion within the housing recess, wherein said connector has a first end section in contact with the electrical conductor and further has a second end section in contact with the electrical contact for maintaining electrical conductivity between the electrical conductor and the electrical contact when the distance between the electrical conductor and the electrical contact changes, a primary seal for contacting the housing and the electrical conductor to isolate the housing recess from the pressurized well;

a secondary seal for isolating said primary seal from the well pressure; and a primary retainer engagable with the housing for anchoring the electrical conductor to the housing, for urging said secondary seal into contact with the housing and the insulated electrical conductor to prevent fluid migration therebetween, and for moving the electrical conductor toward the electrical contact as said primary retainer engages the housing.

2. A high pressure connector as recited in claim 1, further comprising an insulator between said connector and the interior of the housing recess.

3. A high pressure connector as recited in claim 1, wherein said primary seal is substantially metallic.

4. A high pressure connector as recited in claim 1, wherein said secondary seal is substantially metallic.

5. A high pressure connector as recited in claim 1, wherein an exposed portion of the insulated electrical conductor provides the electrical contact with the second end section of said connector.

6. A high pressure connector as recited in claim 1, wherein said primary retainer is threadably engaged with the housing recess.

7. A high pressure connector as recited in claim 1, further comprising a second retainer for urging a substantially metallic seal against said primary retainer.

8. A high pressure connector as recited in claim 1, further comprising a test attachment engaged with said primary retainer for permitting the pressure testing of said primary seal.

9. A high pressure connector for connecting an insulated electrical conductor to an electrical contact for use downhole in a pressurized well, comprising:

a housing having a recess for retaining the electrical contact within the interior space of said housing;

a connector for insertion within said recess and having a first end section in contact with the electrical conductor and having a second end section in contact with the electrical contact for maintaining electrical conductivity between the electrical conductor and the electrical contact when the distance between the electrical conductor and the electrical contact changes;

a primary seal for contacting said housing and the outside surface of the insulated electrical conductor to form a fluid tight seal therebetween;

a primary retainer engaged with said housing for anchoring said primary seal against said housing and for moving the electrical conductor toward the electrical contact as said primary retainer engages the housing;

a nonelastomeric seal for isolating said primary seal from the well pressure; and a secondary retainer for anchoring said nonelastomeric seal.

10. A high pressure connector as recited in claim 9, further comprising an insulator between said connector and the interior surface of said housing recess.

11. A high pressure connector as recited in claim 9, wherein said insulated electrical conductor is encased within a metal jacket, and wherein said housing and primary seal are metallic to form a metal-to-metal seal between said housing and insulated electrical conductor.

12. A high pressure connector as recited in claim 11, wherein said secondary seal is metallic and is anchored by said primary retainer against said housing and said primary retainer to form a metal-to-metal seal between said housing and said primary retainer.

13. A high pressure connector as recited in claim 11, wherein said secondary seal is metallic and is anchored by said secondary retainer against said primary retainer and the metal jacket of said insulated electrical conductor to form a metal-to-metal seal between said primary retainer and said metal jacket.

14. A high pressure connector for connecting a metal jacketed electrical conductor to an electrical contact, retained in the recess of a housing, for use downhole in a pressurized well, comprising:

a connector for insertion within said recess, wherein said connector has a first end section attached to the electrical conductor, and wherein said connector has a second end section for contacting the electrical contact to maintain electrical conductivity between the jacketed electrical conductor and the electrical contact as said connector is moved relative to the electrical contact;

a primary seal for contacting the housing and the metal jacketed electrical conductor to prevent fluid migration therebetween;

a primary retainer engagable with the housing for anchoring said primary seal into contact with the housing and the jacketed electrical conductor;

a nonelastomeric secondary seal for isolating said primary seal from the well pressure; and a secondary retainer for anchoring said secondary seal.

15. A high pressure connector as recited in claim 14, further comprising an insulator between said connector and said housing.

16. A high pressure connector as recited in claim 14, wherein said housing and said primary seal are metallic to form a metal-to-metal seal between said housing and said jacketed electrical conductor.

17. A high pressure connector as recited in claim 16, wherein said primary retainer is metallic, and wherein said secondary seal is metallic and is anchored by said secondary retainer against said electrical conductor and said primary retainer to form a metal-to-metal seal between said electrical conductor and said primary retainer.

18. A high pressure conductor as recited in claim 16, wherein said primary retainer is metallic, and wherein said secondary seal is metallic and is anchored by said secondary retainer against said primary retainer and the metal jacket of said electrical conductor to form a metal-to-metal seal between said primary retainer and said metal jacket.

* * * * *